US008231743B2

(12) United States Patent
Wiles et al.

(10) Patent No.: US 8,231,743 B2
(45) Date of Patent: Jul. 31, 2012

(54) COMPOSITION AND PROCESS FOR IMPROVED ZINCATING MAGNESIUM AND MAGNESIUM ALLOY SUBSTRATES

(75) Inventors: Jacob Grant Wiles, Fort Mill, SC (US); Nayan H. Joshi, Rock Hill, SC (US)

(73) Assignee: Atotech Deutschland GmbH, Berlin (DE)

( * ) Notice: Subject to any disclaimer, the term of this patent is extended or adjusted under 35 U.S.C. 154(b) by 223 days.

(21) Appl. No.: 12/603,743

(22) Filed: Oct. 22, 2009

(65) Prior Publication Data

US 2011/0094631 A1 Apr. 28, 2011

(51) Int. Cl.
*C23C 22/57* (2006.01)
*C23C 22/00* (2006.01)

(52) U.S. Cl. ..... 148/275; 205/185; 148/243; 148/262; 148/267; 148/274; 148/253; 106/14.11

(58) Field of Classification Search ..... 148/243, 148/262, 267, 274–275, 253; 205/185; 106/14.11
See application file for complete search history.

(56) References Cited

U.S. PATENT DOCUMENTS

| | | | |
|---|---|---|---|
| 2,526,544 | A | 10/1950 | De Long |
| 2,730,490 | A | 1/1956 | Hendrich et al. |
| 3,099,083 | A | 7/1963 | De Long |
| 3,216,835 | A | 11/1965 | Saubestre |
| 3,631,835 | A | 1/1972 | Hamontre |
| 4,167,459 | A | 9/1979 | Lee et al. |
| 4,346,128 | A | 8/1982 | Loch |
| 4,567,066 | A | 1/1986 | Schultz et al. |
| 5,141,778 | A | 8/1992 | Yarkosky et al. |
| 5,795,662 | A | 8/1998 | Maezono et al. |
| 6,068,938 | A | 5/2000 | Kato et al. |
| 6,790,265 | B2 * | 9/2004 | Joshi et al. ..... 106/1.17 |
| 6,875,334 | B2 | 4/2005 | Ostrovsky |
| 2008/0131728 | A1 | 6/2008 | Nadupparambil Sekharan et al. |

FOREIGN PATENT DOCUMENTS

| | | | |
|---|---|---|---|
| CN | 101 153 388 | | 4/2008 |
| CN | 101191242 | * | 6/2008 |
| JP | 02254179 | | 10/1990 |
| SU | 687145 | * | 9/1979 |
| WO | 2008011627 | | 1/2008 |

OTHER PUBLICATIONS

PCT/US2010/052771; PCT International Search Report and Written Opinion of the International Searching Authority dated Mar. 25, 2011.

N. El Mahallawy et al; Surface & Coatings Technology 202 (2008) 5151-5157; Electroless Ni-P coating of different magnesium alloys.

The Surface Treatment and Finishing of Aluminium and its Alloys; Fifth Edition; vol. 2; pp. 1022-1053, (1987).

T.W. Jelinek, ed.; Oberflachenbehandlung von Aluminium; pp. 498-507, (1997).

S. Wernick Ph.D; Surface Treatment and Finishing of Light Metals; Part XII-C. Plating on Aluminum; Metal Finishing, Feb. 1957; pp. 61-65.

J.E. Gray et al; Protective coatings on magnesium and its alloys—a critical review; Journal of Alloys and Compounds 336 (2002) 88-113.

Jueling Chen et al; A zinc transition layer in electroless nickel plating; Surface & Coatings Technology 201 (2006) 686-690.

* cited by examiner

*Primary Examiner* — Lois Zheng
(74) *Attorney, Agent, or Firm* — Renner, Otto, Boisselle & Sklar

(57) ABSTRACT

Improved compositions and processes for zincating magnesium and magnesium alloy substrates. An aqueous zincating composition having a pH of from about 8 to about 11 and including zinc ions, a complexing agent, fluoride ions and a reducing agent. A non-electrolytic process for zincating a magnesium or magnesium alloy substrate, including immersing the substrate in the non-electrolytic aqueous zincating composition for a time sufficient to deposit a zincate on the substrate. A non-electrolytic process for zincating a magnesium or magnesium alloy substrate, including preparing a aqueous non-electrolytic composition comprising zinc ions, a complexing agent, fluoride ions and a pH in the range from about 8 to about 11; adding to the composition an amount of a reducing agent sufficient to improve deposition of zincate on the magnesium or magnesium alloy substrate; and immersing the substrate in a composition for a time sufficient to deposit the zincate on the substrate.

16 Claims, No Drawings

COMPOSITION AND PROCESS FOR IMPROVED ZINCATING MAGNESIUM AND MAGNESIUM ALLOY SUBSTRATES

TECHNICAL FIELD

The present invention relates to the field of zincating as applied to substrates formed of magnesium and magnesium alloys. More specifically the present invention relates to improved compositions and processes for applying a zincate coating to such substrates.

BACKGROUND

In the metal plating arts, it has long been known that substrates of magnesium and magnesium alloys are among the most difficult metal substrates to be plated with other metals. A number of compositions and processes have been used in an effort to obtain a reliably good coating of various metals on substrates of magnesium and magnesium alloys. However, the coatings thus obtained have not been wholly satisfactory in terms of the quality of the formed layer on the substrate, in terms of the complexity of the process required or both. The quality of the formed layer has been unsatisfactory in one or more of adhesion, completeness of coverage, appearance or protection afforded to the substrate of magnesium or magnesium alloy.

Due to the fact that substrates of magnesium and magnesium alloys are such difficult metal substrates to be plated with other metals, there has been a long-felt, continuing need for improved compositions and processes for zincating such substrates. Despite the motivation and numerous attempts, the long-felt continuing need has not been satisfied and so remains.

SUMMARY

The present invention provides a solution to the problem of providing a strongly adherent metal coating on a substrate of magnesium or magnesium alloy, by providing an improved composition and process for zincating magnesium and magnesium alloy substrates. The zincate coating provided is improved significantly with respect to that obtained by use of prior art zincating compositions and processes.

Thus, in one embodiment, the present invention relates to an aqueous zincating composition having a pH of from about 8 to about 11 and comprising zinc ions, a complexing agent, fluoride ions and a reducing agent.

In another embodiment, the present invention relates to a non-electrolytic process for zincating a magnesium or magnesium alloy substrate, comprising:

immersing the substrate in a non-electrolytic aqueous zincating composition for a time sufficient to deposit a zincate on the substrate, wherein the composition comprises zinc ions, a complexing agent, fluoride ions and a reducing agent and has a pH in the range from about 8 to about 11.

In another embodiment, the present invention relates to a non-electrolytic process for zincating a magnesium or magnesium alloy substrate, comprising:

preparing an aqueous non-electrolytic composition comprising zinc ions, a complexing agent, fluoride ions and a pH in the range from about 8 to about 11;

adding to the composition an amount of a reducing agent sufficient to improve deposition of zincate on the magnesium or magnesium alloy substrate; and immersing the substrate in the composition for a time sufficient to deposit the zincate on the substrate.

In one embodiment, the complexing agent is provided as a pyrophosphate salt, a tripolyphosphate salt, a phosphate salt or a mixture of two or more thereof.

In one embodiment, the salt comprises potassium, sodium or ammonium cations or a mixture thereof.

In one embodiment, the zinc ions are provided as one or more of zinc sulfate, zinc acetate, zinc oxide, zinc chloride, zinc fluoride, zinc citrate or zinc sulfonate.

In one embodiment, the fluoride ions are provided as one or more of potassium fluoride, sodium fluoride, zinc fluoride, ammonium fluoride or ammonium bifluoride.

In one embodiment, the reducing agent is provided as one or more of a hypophosphite, a borane compound, a borohydride, a hydrazine, an alkyl- and/or an aryl-substituted hydrazine, a phosphite, a hydroxylamine, ascorbic acid, isoascorbic acid, formaldehyde, hypophosphoric acid, and phosphorous acid.

In one embodiment, the composition comprises:

from about 0.005 M to about 1.5 M of the zinc ions, from about 0.01 M to about 2 M of the complexing agent, from about 0.0025 M to about 1.5 M of the fluoride ions and from about 0.005 M to about 1.5 M of the reducing agent.

In one embodiment, the deposition and/or at least one property of the zincate is improved compared to the same process in the absence of the reducing agent.

In one embodiment, the amount of reducing agent is sufficient to improve at least one property of the zincate deposited on the substrate, wherein the at least one property comprises one or more of brightness, color, shininess, adhesion to the substrate and thickness uniformity.

Thus, the present invention addresses and provides a satisfactory solution to the long-felt, continuing need for improved compositions and processes for zincating substrates of magnesium and magnesium alloys, in preparation for plating such substrates with other metals.

DETAILED DESCRIPTION

Throughout the disclosure and claims, the numerical limits of the ranges and ratios may be combined, and all ranges are deemed to include all subranges in unit increments.

Throughout the disclosure and claims, in listing alternatives, the disclosure is deemed to include all possible combinations of each listed alternative with each alternative in other lists, so that every combination of all possible alternatives is within the scope of the disclosure of the present invention. Furthermore, any individual member of a group of listed alternatives may be deleted from the list, and every subcombination resulting from such deletion is within the scope of the disclosure of the present invention.

Substrates

The substrates to which the compositions and processes in accordance with the present invention are applied include a wide variety of articles having in common that they are formed of magnesium or a magnesium alloy. Magnesium alloys are defined, for example, in ISO 16220:2005, in ASTM B94-07 Standard Specification for Magnesium-Alloy Die Castings, and in various other industrial, military and/or governmental standards. As used herein, the terms magnesium and magnesium alloy are defined to include these materials as understood in the art.

The following magnesium alloys are provided for exemplary, non-limiting purposes only, it being understood that the present invention is generally applicable to magnesium and all magnesium alloys. Many magnesium alloys are identified by abbreviations indicating the primary alloying metals. For example, aluminum is frequently present, and many magnesium alloys carry a name beginning with "A". Thus, magnesium alloys include, for example, alloys such as magnesium alloys AZ91A, -B, -C, -D, and -E, which include aluminum ranging from 8.1%-9.7%, zinc 0.35%-1%, and varying amounts of manganese, silicon, copper, nickel, iron and other trace elements. Although many other alloys of magnesium are known, the AZ91 alloys are of particular interest. As noted, there are many known magnesium alloys and the foregoing represents only an exemplary sampling. The present invention is considered to be applicable to all magnesium alloys, unless otherwise specified.

Compositions

In accordance with embodiments of the present invention, the compositions used for zincating the magnesium and magnesium alloys are aqueous zincating compositions having a pH of from about 8 to about 11 and comprising zinc ions, a complexing agent, fluoride ions and a reducing agent.

In addition to the above range, in one embodiment, the pH is in the range from about 9 to about 11, and in another embodiment, the pH is in the range from about 9.5 to about 10.5. In this context, the "about" includes a pH range of +/− 0.1 pH unit from each respective specified value. The pH is determined by use of a suitable pH meter at the operating temperature of the zincating composition.

In one embodiment, the zinc ions are provided as one or more of zinc sulfate, zinc acetate, zinc hydroxide, zinc oxide, zinc chloride, zinc fluoride, zinc citrate or zinc sulfonate. Other water soluble zinc salts may also be used.

In one embodiment, the complexing agent is provided as a pyrophosphate salt, a tripolyphosphate salt, a phosphate salt or a mixture of two or more thereof. In one embodiment, the pyrophosphate salt comprises potassium, sodium or ammonium cations or a mixture thereof. In one embodiment, the complexing agent is or comprises tetrapotassium pyrophosphate, in another embodiment, the complexing agent is or comprises tetrasodium pyrophosphate, and in another embodiment, the complexing agent is or comprises tetraammonium pyrophosphate. Of course, other complexing agents may be used, but the foregoing phosphorus-based complexing agents have been found useful.

In one embodiment, the fluoride ions are provided as one or more of potassium fluoride, sodium fluoride, zinc fluoride, ammonium fluoride or ammonium bifluoride. Other soluble fluoride salts may also be used.

In one embodiment the zinc and fluoride are added as zinc fluoride, use of which minimizes the number of other ions added to the composition.

In one embodiment, the reducing agent is provided as one or more of a hypophosphite, a borane compound, a borohydride, a hydrazine, an alkyl- and/or an aryl-substituted hydrazine, a phosphite, a hydroxylamine, ascorbic acid, isoascorbic acid, formaldehyde, hypophosphoric acid, and phosphorous acid. In one embodiment, the reducing agent is one or a combination of sodium hypophosphite, sodium borohydride ($NaBH_4$), dimethylamino borane (DMAB), or hydroxylamine sulfate (HAS). Where suitable or preferred, the reducing agent may be added as a solution in a solvent such as water.

The range of concentration of the specifically enumerated ingredients may be suitably adjusted.

In one embodiment, the zinc ions are added at a concentration in the range from about 0.005 mole per liter (M) to about 1.5 M, in one embodiment, from about 0.01 M to about 1 M, and in one embodiment, from about 0.1 M to about 0.5 M, and in one embodiment, about 0.3 M, in the form of a suitable zinc salt or as zinc hydroxide.

In one embodiment, the complexing agent is added at a concentration in the range from about 0.01 M to about 2 M, in one embodiment, from about 0.1 M to about 1 M, and in one embodiment, from about 0.25 M to about 0.75 M, and in one embodiment, about 0.6 M, in the form of a suitable compound such as tetrapotassium pyrophosphate or one of the other complexing agents disclosed herein.

In one embodiment, the fluoride ions are added at a concentration in the range from about 0.0025 M to about 1.5 M, in one embodiment, from about 0.01 M to about 1 M, and in one embodiment, from about 0.05 M to about 0.5 M, and in one embodiment, about 0.12 M, in the form of a suitable fluoride salt or as hydrogen fluoride.

In one embodiment, the reducing agent is added at a concentration in the range from about 0.005 M to about 1.5 M, in one embodiment, from about 0.01 M to about 1 M, and in one embodiment, from about 0.25 M to about 0.75 M, and in one embodiment, about 0.6 M, in the form of a suitable compound such as sodium hypophosphite, hydroxylamine sulfate or one of the other reducing agents disclosed herein.

In one embodiment, the improved zincating composition in accordance with the present invention contains:

from about 0.005 M to about 1.5 M of the zinc ions, from about 0.01 M to about 2 M of the complexing agent, from about 0.0025 M to about 1.5 M of the fluoride ions and from about 0.005 M to about 1.5 M of the reducing agent.

In one embodiment, expressed in grams per liter (g/l), the improved zincating composition in accordance with the present invention contains:

from about 1 to about 50 g/l of the zinc ions, from about 20 to about 240 g/l of the complexing agent, from about 0.05 to about 50 g/l of the fluoride ions and from about 1 to about 50 g/l of the reducing agent.

As will be recognized by those having skill in the art, suitable concentrations of the ingredients in the zincating composition can be determined based on the foregoing general guidelines, the particular ingredients selected (i.e., which zinc salt, which fluoride, which complexing agent and which reducing agent), the desired process, that person's knowledge and the particular substrate, the desired subsequent electrodeposit and the features of the desired product.

Processes

In the present invention, the zincating process is non-electrolytic. In accordance with embodiments of the present invention, the non-electrolytic process for zincating a magnesium or magnesium alloy substrate includes immersing the substrate in a non-electrolytic composition for a time sufficient to deposit a zincate on the substrate, in which the composition comprises zinc ions, a complexing agent, fluoride ions and a reducing agent and has a pH in the range from about 8 to about 11, or other range as described above. In one embodiment, the complexing agent may be any described above. In one embodiment, the zinc ions may be provided in any of the forms described above. In one embodiment, the fluoride ions may be provided in any of the forms described above. In one embodiment, the reducing agent may be provided in any of the forms described above. In one embodiment, the zincating composition contains from about 0.005 M to about 1.5 M of the zinc ions, from about 0.01 M to about 2 M of the complexing agent, from about 0.0025 M to about 1.5 M of the fluoride ions and from about 0.005 M to about 1.5 M of the reducing agent, or otherwise within the ranges of concentration as described above.

In accordance with the present invention, as a result of using the disclosed composition in the process, the deposition and/or at least one property of the zincate is improved compared to the same process in the absence of the reducing agent. The amount of reducing agent used is selected to be sufficient to improve at least one property of the zincate deposited on the substrate. The at least one property includes one or more of brightness, color, shininess, adhesion to the substrate and thickness uniformity, in accordance with embodiments of the present invention.

In accordance with embodiments of the present invention, the non-electrolytic process for zincating a magnesium or magnesium alloy substrate includes preparing an aqueous non-electrolytic composition comprising zinc ions, a complexing agent, fluoride ions and a pH in the range from about 8 to about 11;

adding to the composition an amount of a reducing agent sufficient to improve deposition of zincate on the magnesium or magnesium alloy substrate; and immersing the substrate in a composition for a time sufficient to deposit the zincate on the substrate.

In one embodiment, the magnesium or magnesium alloy substrate is treated with the zincating composition for a period ranging from about 1 minute to about 60 minutes, and in another embodiment, the magnesium or magnesium alloy substrate is treated with the zincating composition for a period ranging from about 5 minutes to about 30 minutes, and in another embodiment, the magnesium or magnesium alloy substrate is treated with the zincating composition for a period of about 10 minutes.

In one embodiment, the magnesium or magnesium alloy substrate is treated with the zincating composition at a temperature ranging from about 20° C. to about 95° C., and in another embodiment, the magnesium or magnesium alloy substrate is treated with the zincating composition at a temperature ranging from about 50° C. to about 85° C., and in another embodiment, the magnesium or magnesium alloy substrate is treated with the zincating composition at a temperature ranging from about 65° C. to about 70° C.

In various embodiments, the magnesium or magnesium alloy substrate may be contacted with the zincating composition by any known method for applying a liquid-based composition to a solid substrate, including, for example, immersing, dipping, spraying, wiping, brushing, flooding, cascading, roller-coating, or flow-coating or combinations of any two or more of the foregoing.

In accordance with this embodiment, as with the invention in general, the amount of reducing agent used is selected to be sufficient to improve at least one property of the zincate deposited on the substrate, in which the at least one property includes one or more of brightness, color, shininess, adhesion to the substrate and thickness uniformity.

EXAMPLES

The following non-limiting examples are provided to demonstrate certain embodiments of the present invention. These examples are intended to be exemplary only, and it is understood that the examples are provided for understanding the present invention and that the examples do not limit the scope of the invention, which is defined by the appended claims.

The following compositions are prepared by dissolving the indicated number of grams or milliliters of each listed component in water and diluting to a final volume of one liter. Therefore, except for the cases in which a liquid is used and added by volume, all of the concentrations are in grams per liter. As indicated, the sodium borohydride and the dimethylamino borane are added in the indicated volumes, from the solutions as obtained commercially as shown below. In all examples, except examples 9 and 10, the pH is adjusted to 10.3 determined at a temperature of 65° C. The pH of examples 9 and 10 is allowed to remain at the value reached upon addition of the reducing agent solutions, i.e., at pH 10.7 and 10.8 determined at a temperature of 65° C., respectively, for the experiments. All experiments are carried out at a temperature in the range of 65° C. to 70° C.

| | Comp. | Invention Examples | | | | | | | | |
|---|---|---|---|---|---|---|---|---|---|---|
| | Ex. 1 | 2 | 3 | 4 | 5 | 6 | 7 | 8 | 9 | 10 |
| TKPP | 120 | 120 | 120 | 120 | 120 | 120 | 120 | 120 | 120 | 120 |
| $ZnSO_4$ | 30 | 30 | 30 | 30 | 30 | 30 | 30 | 30 | 30 | 30 |
| Hypo | | 5 | 15 | 25 | 15 | 15 | | | | |
| $NaBH_4$ | | | | | | | | | 1.7 ml | |
| DMAB | | | | | | | | | | 2.1 ml |
| HAS | | | | | | | 5 | 20 | | |
| KF | 7 | | | | | | 7 | 7 | 7 | 7 |
| NaF | | | | | 5 | | | | | |
| $NH_4F$ | | | | | | 5 | | | | |
| $KCO_3$ | 10 | 10 | 10 | 10 | 10 | 10 | 10 | 10 | 10 | 10 |
| Water | Add water q.s. to final volume of 1 liter | | | | | | | | | |

Comp. Ex. 1 = Comparative Example 1, composition disclosed in U.S. Pat. No. 2,526,544. TKPP = tetrapotassium pyrophosphate $ZnSO_4$ = zinc sulfate heptahydrate ($ZnSO_4 \cdot 7\ H_2O$)

Hypo = sodium hypophosphite hydrate ($NaH_2PC_2 \cdot x\ H_2O$)

$NaBH_4$ = sodium borohydride, 12% by wt. aqueous solution @ pH ~12-12.5

DMAB = dimethylamino borane, 10% by wt. aqueous solution @ pH ~11.5

HAS = hydroxylamine sulfate.

Dry ingredients are added to the nascent zincating composition by weight, dry and as obtained from suppliers; aqueous solutions of $NaBH_4$ or DMAB are used as received from the commercial supplier. All of these ingredients are readily available commercially.

The foregoing zincating compositions are tested in a non-electrolytic zincating process with AZ91 magnesium alloy panels obtained from ACT Test Panel Technologies, Hillsdale, Mich., USA, followed by application of an electrolytic cyanide copper strike. One side of each panel is polished with a 600 grit sand paper to obtain a smooth and even surface, while the other side is left in the condition as received from ACT. Each test panel is subjected to the following process:

| Treatment: | Time(min.) | Temp.(° C) | Conc. |
|---|---|---|---|
| EXPT PrepAlloy Cleaner L | 10 | 65 | 10% |
| EXPT PrepAlloy AE | 2 | RT | 15% |
| EXPT PrepAlloy ACT-1 | 3 | 45 | 50% |
| Zincate as in Table above | 10 | 65 | above |
| Cyanide Copper Strike | 5 | 60 | conventional |
| Rinse | 0.5-0.75 | RT | tap water |

Each of the test panels are evaluated for appearance and are subjected to adhesion tests according to a standard knife and tape test following the copper strike and rinse. In the knife and tape test, following the application of the copper strike and rinse, the newly plated surface is scratched with a knife edge in a cross-hatch grid pattern in which the parallel knife cuts are about 3 mm apart and penetrate through the applied layers into the magnesium or magnesium alloy substrate. Any debris from the cuts is removed. Next, an adhesive tape (e.g., Permacel 99 or 3M Scotch 720 Film Fiber Tape, both packaging tapes available commercially) is applied to the grid pattern of cuts, pressed on firmly and then smoothly removed in a fluid motion. Any lift-off of the copper layer is noted and reported. The results reported in the tables below apply to both sides of the sample substrates.

Results:

| Example | Appearance of Zincate Deposit |
|---|---|
| 1 | darker gray with areas of blisters with a spongy type deposit |
| 2 | Light bluish gray, uniform zincate deposit. |
| 3 | Light bluish gray, uniform zincate deposit. |
| 4 | Light bluish gray, uniform zincate deposit. |
| 5 | Light bluish gray semi uniform w/areas of thin zincate deposit |
| 6 | Light bluish gray, uniform zincate deposit. |
| 7 | Light bluish gray, uniform zincate deposit. |
| 8 | Light bluish gray semi uniform w/areas of thin zincate deposit |
| 9 | Bluish gray semi-uniform zincate deposit; heavy gassing (only 5 min immersion in zincating bath) |
| 10 | Bluish gray deposit, uniform zincate deposit; (only 5 min immersion in zincating bath). |

| Example | Adhesion Result in Knife and Tape Test |
|---|---|
| 1 | poor adhesion with zincate, no cyanide copper electrodeposit possible |
| 2 | ok, no peel off |
| 3 | ok, no peel off |
| 4 | ok, no peel off |
| 5 | ok, no peel off, one or two areas of gray, possibly thin zincate |
| 6 | ok, no peel off |
| 7 | ok, no peel off |
| 8 | ok, no peel off, one or two areas of gray, possibly thin zincate |
| 9 | ok, no peel off |
| 10 | ok, no peel off |

As demonstrated by the foregoing examples, the zincating process in accordance with embodiments of the present invention provides a zincate having excellent appearance and adhesion of subsequently applied metal layers.

It is noted that, throughout the specification and claims, the numerical limits of the disclosed ranges and ratios may be combined, and are deemed to include all intervening values. Furthermore, all numerical values are deemed to be preceded by the modifier "about", whether or not this term is specifically stated.

While the principles of the invention have been explained in relation to certain particular embodiments, and are provided for purposes of illustration, it is to be understood that various modifications thereof will become apparent to those skilled in the art upon reading the specification. Therefore, it is to be understood that the invention disclosed herein is intended to cover such modifications as fall within the scope of the appended claims. The scope of the invention is limited only by the scope of the claims.

The invention claimed is:

1. An aqueous zincating composition having a pH of from about 8 to about 11 and comprising zinc ions, a complexing agent, fluoride ions and a reducing agent, wherein the reducing agent is one or more selected from the group consisting of a hypophosphite, a borane compound, a borohydride, a hydrazine, an alkyl- and/or an aryl-substituted hydrazine, a phosphite, ascorbic acid, isoascorbic acid, hypophosphoric acid, and phosphorous acid.

2. The composition of claim 1 wherein the complexing agent is provided as a pyrophosphate salt, a tripolyphosphate salt, a phosphate salt or a mixture of two or more thereof.

3. The composition of claim 2 wherein the salt comprises potassium, sodium or ammonium cations or a mixture thereof.

4. The composition of claim 1 wherein the zinc ions are provided as one or more of zinc sulfate, zinc acetate, zinc oxide, zinc chloride, zinc fluoride, zinc citrate or zinc sulfonate.

5. The composition of claim 1 wherein the fluoride ions are provided as one or more of potassium fluoride, sodium fluoride, zinc fluoride, ammonium fluoride or ammonium bifluoride.

6. The composition of claim 1 wherein the composition comprises:

from about 0.005 M to about 1.5 M of the zinc ions, from about 0.01 M to about 2 M of the complexing agent, from about 0.0025 M to about 1.5 M of the fluoride ions and from about 0.005 M to about 1.5 M of the reducing agent.

7. A non-electrolytic process for zincating a magnesium or magnesium alloy substrate, comprising:

immersing the substrate in a non-electrolytic aqueous zincating composition for a time sufficient to deposit a zincate on the substrate, wherein the composition comprises zinc ions, a complexing agent, fluoride ions and a reducing agent and has a pH in the range from about 8 to about 11, wherein the reducing agent is one or more selected from the group consisting of a hypophosphite, a borane compound, a borohydride, a hydrazine, an alkyl- and/or an aryl-substituted hydrazine, a phosphite, ascorbic acid, isoascorbic acid, hypophosphoric acid, and phosphorous acid.

8. The process of claim 7 wherein the complexing agent is provided as comprises a pyrophosphate salt, a tripolyphosphate salt, a phosphate salt or a mixture of two or more thereof.

9. The process of claim 8 wherein the salt comprises potassium, sodium or ammonium cations or a mixture thereof.

10. The process of claim 7 wherein the zinc ions are provided as one or more of zinc sulfate, zinc acetate, zinc hydroxide, zinc oxide, zinc chloride, zinc fluoride, zinc citrate or zinc sulfonate.

11. The process of claim 7 wherein the fluoride ions are provided as one or more of potassium fluoride, sodium fluoride, zinc fluoride, ammonium fluoride or ammonium bifluoride.

12. The process of claim 7 wherein the composition comprises:

from about 0.005 M to about 1.5 M of the zinc ions, from about 0.01 M to about 2 M of the complexing agent, from about 0.0025 M to about 1.5 M of the fluoride ions and from about 0.005 M to about 1.5 M of the reducing agent.

13. The process of claim 7 wherein the deposition and/or at least one property of the zincate is improved compared to the same process in the absence of the reducing agent.

14. The process of claim 7 wherein the amount of reducing agent is sufficient to improve at least one property of the zincate deposited on the substrate, wherein the at least one property comprises one or more of brightness, color, shininess, adhesion to the substrate and thickness uniformity.

15. A non-electrolytic process for zincating a magnesium or magnesium alloy substrate, comprising:

preparing an aqueous non-electrolytic composition comprising zinc ions, a complexing agent, fluoride ions and a pH in the range from about 8 to about 11;

adding to the composition an amount of a reducing agent sufficient to improve deposition of zincate on the magnesium or magnesium alloy substrate; and immersing the substrate in the composition for a time sufficient to deposit the zincate on the substrate, wherein the reducing agent is one or more selected from the group consisting of a hypophosphite, a borane compound, a borohydride, a hydrazine, an alkyl- and/or an aryl-substituted hydrazine, a phosphite, ascorbic acid, isoascorbic acid, hypophosphoric acid, and phosphorous acid.

16. The process of claim 15 wherein the amount of reducing agent is sufficient to improve at least one property of the zincate deposited on the substrate, wherein the at least one property comprises one or more of brightness, color, shininess, adhesion to the substrate and thickness uniformity.

* * * * *